United States Patent [19]

Higginbotham et al.

[11] Patent Number: 4,474,224

[45] Date of Patent: Oct. 2, 1984

[54] FOUNDRY MACHINERY

[75] Inventors: Gordon J. S. Higginbotham, Darley Abbey; Clifford R. Amsbury, Smalley; Graham C. Starkey, Mickleover, all of England

[73] Assignee: Rolls-Royce Limited, London, England

[21] Appl. No.: 387,746

[22] Filed: Jun. 11, 1982

[30] Foreign Application Priority Data

Aug. 12, 1981 [GB] United Kingdom ..... 8124641

[51] Int. Cl.[3] ..... B22D 33/04; B22C 19/04

[52] U.S. Cl. ..... 164/150; 164/340; 164/122.1

[58] Field of Search ..... 164/137, 339, 340, 150, 164/122.1; 83/81, 170, 198; 140/93 R

[56] References Cited

U.S. PATENT DOCUMENTS 3,401,738 9/1968 Parille ..... 164/399

3,596,703 8/1971 Bishop et al. ..... 164/340

*Primary Examiner*—Kuang Y. Lin

*Assistant Examiner*—Richard K. Seidel

*Attorney, Agent, or Firm*—Cushman, Darby & Cushman

[57] ABSTRACT

A machine for inserting a core supporting pin into a wax pattern includes a wax pattern support and a pin holder holding a continuous length of pin material means being provided to automatically cut off the pin length and for displacing the pin holder such that the pre-heated pin may be inserted into the wax pattern.

3 Claims, 3 Drawing Figures

FOUNDRY MACHINERY

Figure 1:
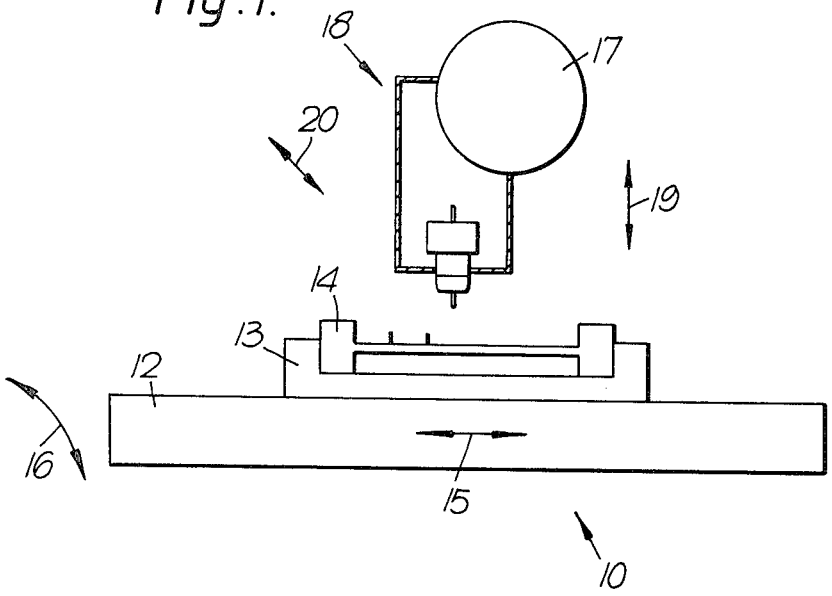

This invention relates to foundry machinery and more particularly to such a machine for inserting core supporting pins into a wax pattern including a core prior to shelling, the pins serving to support the core from the shell after removal of the wax.

The investment casting process using shell moulds is frequently used to produce castings which have complex hollow interiors, such as for example gas turbine blades or vanes including cooling passageways therein. In order to provide the hollow interior it is necessary to use a core, usually ceramic in composition. However any slight movement of the core which may occur during removal of the wax or during the metal pouring can result in scrapping the casting.

A well known means of preventing such movement of the core within the shell mould is the use of a plurality of thin wire support pins which are secured within the shell mould and extend into engagement with the surface of the core thereby spacing the core from the walls of the casting cavity defined by the shell mould.

The thin wire support pins are usually inserted manually into the wax which is injected around the ceramic core prior to manufacture of the shell mould. The pins may either be pre-heated to facilitate penetration of the wax pattern or alternatively small holes may be drilled within the wax to accomodate the support pins which are subsequently secured herein with molten wax.

It will be appreciated that such a method of manually fitting the support pins is both time consuming and tedious.

An object of the present invention is to provide a machine whereby the supporting pins may be inserted into a wax pattern automatically and at a greater rate than has previously been possible.

According to the present invention a machine for inserting at least one core supporting pin into a wax pattern includes a wax pattern support means, a holder containing a continous length of pin material, means for automatically cutting the pin material to a desired length, a pin holder for holding the cut-off pin, means for heating the pin and means for displacing the pin holder such that the pre-heated pin may be inserted into the wax such that it contacts the ceramic core.

Preferably the continous length of pin consists of a reel of wire.

Furthermore the means for automatically cutting the pin to length consists of an electronically controlled and pnumatically operated wire shearing device.

Preferably the pin holder consists of a collet including an induction coil which heats up the pin.

Preferably the means for displacing the pin holder such that the pin may be inserted into the wax consists of stepping motors which are controlled by a microprocessor unit.

According to a further aspect of the present invention the pin may be brought into contact with the surface of the wax pattern in the un-heated condition and its location electronically noted, after which the pin may be heated and inserted into the wax pattern until it is prevented from further movement by contact with the ceramic core whereupon this location is also electrically noted and means provided to give an indication of the distance between the two respective locations thus giving the wax wall thickness.

Figure 2:
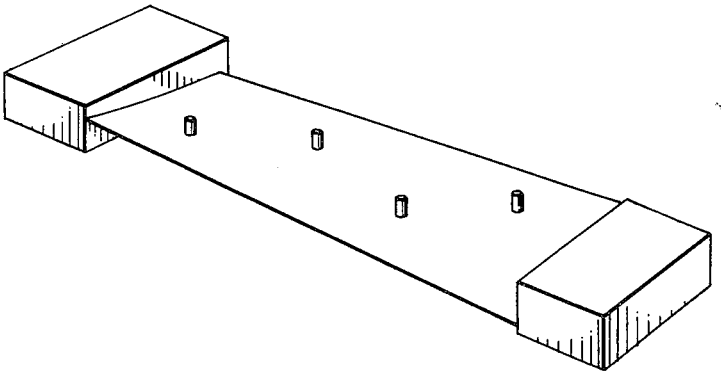

For better understanding of the invention an embodiment thereof will be more particularly described by way of example only and with reference to the accompanying drawings in which FIG. 1 shows a diagramatic view of the machine FIG. 2 shows a pictorial view of a wax pattern including the core supporting pins.

Figure 3:
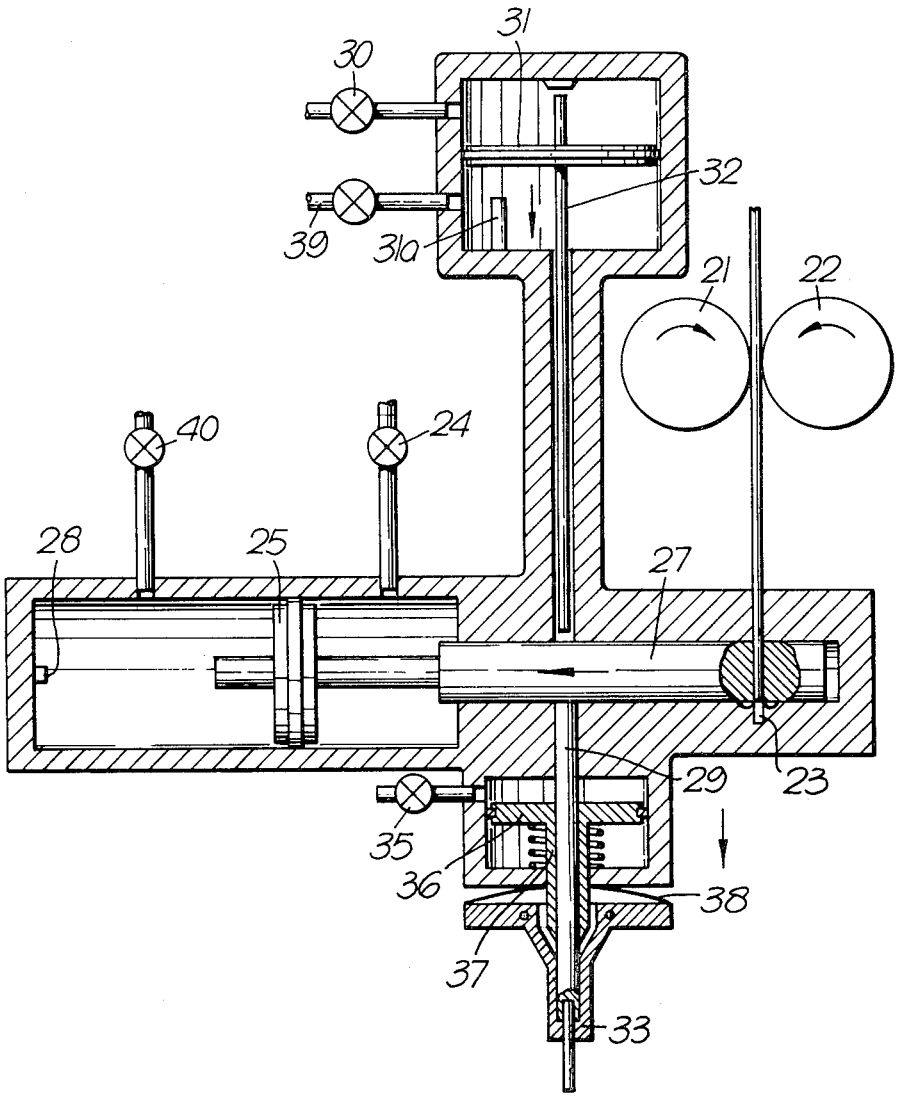

FIG. 3 shows an enlarged cross-sectional view of a portion of the machine shown diagrammatically at FIG. 1.

Referring to the drawings at FIG. 1 there is shown generally at 10 a diagramatic view of a pin inserting machine made in accordance with the present invention. The machine basically comprises a wax pattern supporting table 12 carrying a wax pattern supporting holder 13, within which a wax pattern 14, having a central ceramic core therein, is situated. The table 12 is adapted to be longitudinally displaced and angularly displaced as indicated by arrows 15 and 16 respectively by means of separate stepping motors (not shown in the drawings).

Arranged above the wax pattern supporting table 12 is situated the machine head shown generally at 18 which includes both the continous reel of pin material 17 and both the pin cutting and collet mechanism. This portion of the machine is adapted to be displaced in the vertical plane and in a plane transverse to the longitudinal axis of the wax pattern support table 12 as indicated by arrows 19 and 20 respectively by two further stepping motors (not shown in the drawings).

FIG. 3 of the drawings shows a detailed cross-sectional view of the pin cutting and collet portion of the machine shown diagramatically at FIG. 1.

During operation of the machine a continous length of wire forming the pin material is pulled from the reel 17 by means of pinch rollers 21 and 22 one of which is driven by means of an electric motor (not shown in the drawings). The pinch rollers will continue to pull wire from the reel 17 until its end comes into contact with stop 23 which is adapted to stop the motor. Thereafter a pneumatic valve 24 is opened by electrical means such that the piston 25 moves in the direction of arrow 26, thus shearing off the portion of the wire forming the pin which is trapped within the carrier member 27. The piston 25 continues to move until contacting the stop 28 by which time the carrier member 27 has been displaced such that the cut off pin is in line with the aperture 29.

The piston 25 contacting the stop 28 also serves to open a pneumatic valve 30 which serves to drive piston 31 and its associated spindle 32 vertically downwards until the piston 31 actuates the switch 31*a* which shuts the air supply to valve 30 such that the cut-off pin is positioned within the collet 33.

An induction coil 34 adjacent the collet 33 may then be energised to pre-heat the pin, or alternatively the induction coil may be left permenantly energised to pre-heat the pins.

The machine head shown generally at 18 including the collet etc and the wax pattern supporting table 12 may thereafter be moved by the various stepping motors such that the pre-heated pin is pushed into the wax pattern 14 in a preferred location. The pin is steadily pushed into the wax pattern until it meets the hard and unyielding central ceramic core. Thereafter the pin will slip back in the collet 33 and therefore push the spindle vertically upwards, thus breaking the pistons contact with the switch 31*a* which stops further downward movement of the machine head shown generally at 18.

Pneumatic valve 35 is then actuated to drive the piston 36 vertically downwards such that the tube 37 opens the collet by overcoming the closing force imposed upon it by the Bellville washer 38 therefor releasing the pin.

The machine head 18 is thereafter moved vertically upwards and the pneumatic valves 39 and 40 are opened such that the spindle 32 is moved vertically upwards and the carrier member 27 is moved back to accept a further length of pin material from the reel 17.

It will be appreciated by those skilled in the art that all the respective movements of both pneumatic valves and stepping motors may be controlled conveniently by electronic circuitry 48 including a microprocessor unit 50 and a memory to carry out all the necessary functions demanded during operation of the machine.

According to a further aspect of the invention it is contemplated that the wall thickness of the wax pattern may also be measured during insertion of the pins. This may be conveniently achieved by either not energising the induction coil until after the pin has contacted the surface of the wax such that the location may be determined.

Alternatively for increased speed of operation the induction coil may be left switched on and the tip of the pin cooled with a supply of cooling air until it has made contact with the surface. After contact with the surface has been made, sensor means 52 electronically notes the position or location of the pin and the cooling air supply is terminated thus allowing the pin to quickly heat up and therefor penetrate the wax.

Obviously when the heated pin contacts the ceramic core further movement of the pin is prevented, therefore this location may also be electronically noted by sensor means 52 and obviously the distance between the two locations gives an indication of the wax thickness.

A further alternative is to allow the pin to be slidable within a cooled tube which contacts the surface of the wax and the hot pin may pass through the tube and directly into the wax. The distance the pin is displaced with respect of the tube is thereafter measured to give an inindication of the wax thickness.

All operations of the machine are controlled by a microprocessor system with operating program and data being stored in a read only memory.

The action of the machine is controlled by outputting signals from the processor unit through transistor drive circuitry to the wire feed motor and solenoid operated pneumatic valves for switching compressed air supplies to the machine. Signals from switches and contacts on the machine head are fed back to the processor unit via interface logic to monitor individual functions of the machines cycle. Pin insertion speeds and core sensing are also controlled by the program.

The microprocessor unit 50 is also used to generate the required drive signals and accelerations for the stepping motor drive circuitry or if the motors are being manually controlled the processor is utilised to count the motor pulses to give distance moved or angle of rotation and display in engineering into the displacement from the machine datum.

A series of sensors allows the processor system to automatically identify the type of wax pattern support 13 fitted to the machine and recalls the appropriate pin size and position data from the memory.

Heating of the pin is achieved using an induction heater 34 consisting of a sine wave generator and a power amplifier transformer coupled to a low impedance coil wound round the pin holder. Temperature of the pin holder may be set by adjusting the power drive to the coil.

While on the present described machine pressure switches and contacts are used it is proposed to replace the micro-switch used for blade identification, datuming pin monitoring and core sensing with proximity switches to give improved reliability.

It is also envisaged that the addition of a second microprocessor system may be made to allow simultaneous operation of several machine functions which at present are carried out sequentially thus increasing the speed of operation of the machine.

It will be appreciated by those skilled in the art that although it is contemplated that the control of all the machine functions are carried out electronically using a micro-processor and a memory, such a machine could alternatively be controlled by means of conventional relays etc. or alternatively by mechanical means. It would be unlikely however that such means would be as convenient and reliable as the electronic means specified.

We claim:

1. A machine for inserting at least one core supporting pin into a wax pattern containing at least one ceramic core includes a wax pattern support means, a holder containing a continuous length of pin material, means for automatically cutting the pin material to a desired length, a pin holder for holding the cut-off pin, means for heating the pin, said heating means and said pin holder being adjacent to each other, means for displacing the pin holder such that the pre-heated pin is inserted into the wax such that it contacts the ceramic core, and sensing means for determining positions of the pin.

2. A machine as claimed in claim 1 including a microprocessor unit for an operating program and in which the means for displacing the pin holder such that the pin may be inserted into the wax consists of stepping motors controlled by said microprocessor unit.

3. A machine as claimed in claim 1 in which said pin holder consists of a collet and in which said heating means includes an induction coil which heats up said collet and pin.

* * * * *